US005912645A

United States Patent [19]

Wight et al.

[11] Patent Number: 5,912,645

[45] Date of Patent: Jun. 15, 1999

[54] ARRAY FEED FOR AXIALLY SYMMETRIC AND OFFSET REFLECTORS

[75] Inventors: Jim Wight, Ottawa; David J. Roscoe, Dunrobin, both of Canada

[73] Assignee: Her Majesty the Queen in Right of Canada, as Represented by the Minister of Industry through the Communications Research Centre, Ottawa, Canada

[21] Appl. No.: 08/820,829

[22] Filed: Mar. 19, 1997

Related U.S. Application Data

[60] Provisional application No. 60/013,682, Mar. 19, 1996.

[51] Int. Cl.[6] ..... H01Q 3/02; H01Q 19/12

[52] U.S. Cl. ..... 343/700 MS; 343/840

[58] Field of Search ..... 343/840, 700 MS, 343/844, 853

[56] References Cited

U.S. PATENT DOCUMENTS

| | | | |
|---|---|---|---|
| 1,785,062 | 12/1930 | Whittle | 343/853 |
| 3,182,330 | 5/1965 | Blume | 343/844 |
| 3,811,129 | 5/1974 | Holst | 343/844 |
| 4,843,400 | 6/1989 | Tsao et al. | 343/700 MS |
| 5,539,415 | 7/1996 | Metzen et al. | 343/700 MS |

FOREIGN PATENT DOCUMENTS

| | | | |
|---|---|---|---|
| 2249668 | 5/1992 | United Kingdom | 343/700 MS |

OTHER PUBLICATIONS

Johnson, Richard C., Antenna Engineering Handbook, 3rd ed., McGraw–Hill, Inc. NY, pp. 7–3–4, 20–28–31, 1993.

Current Trends in Antenna Technology and Prospects for the Next Decade A.W. Rudge. IEEE Antennas and Propagation Society Newsletter, Dec. 1983.

Array–fed Reflector Antenna Design and Applications K. Woo. Jet Propulsion Laboratory, California Institute of Technology, USA.

*Primary Examiner*—Don Wong
*Assistant Examiner*—Jennifer H. Malos
*Attorney, Agent, or Firm*—Neil Teitelbaum & Associates

[57] ABSTRACT

In the past, parabolic offset reflector antennas were fed a signal through a corrugated horn in order to optimize field distribution and polarization at the reflector. It has been found that cost savings and other advantages are realized by using an array of radiating patches. The geometrical placement of the radiating patches and the power distribution to each patch is arranged such that radiated energy from the patches sums at the reflector surface to produce the predetermined field distribution and polarization.

30 Claims, 13 Drawing Sheets

-Tx. microstrip patch array

-Rx. microstrip patch array

*a*

*b*

| E(u)/E(0) | u | $r_2$(mm) for 14.25 GHz |
|---|---|---|
| 0.5 | 2.77 | 13.38 |
| 0.707 | 1.92 | 9.27 |
| 0.866 | 1.38 | 6.66 |
| 1.0 | 0.0 | 0.0 |

Fig. 2b dX=dY dX=dY

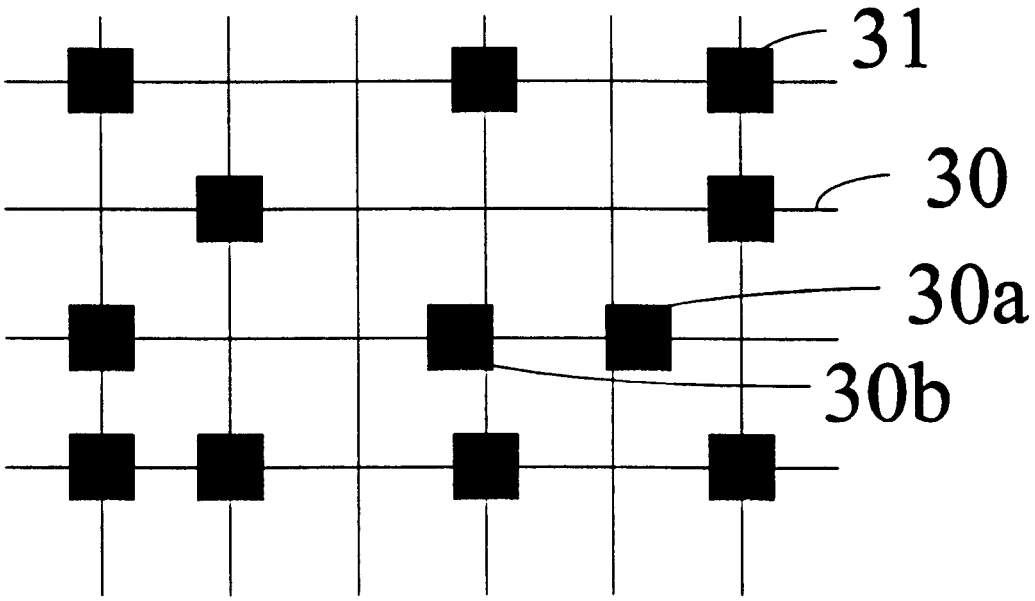
Fig. 3c
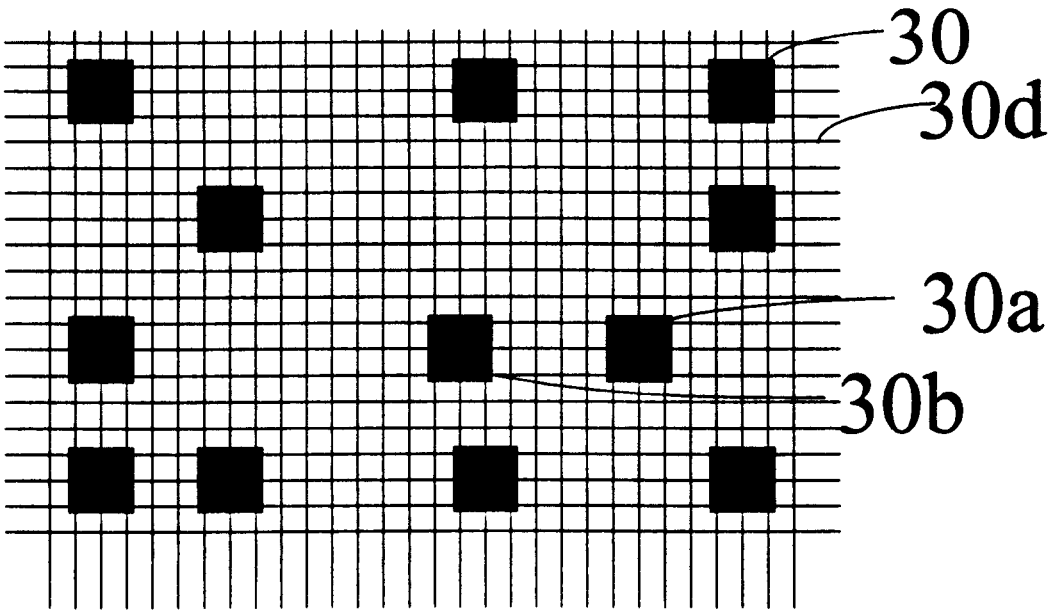
Fig. 3d dX=dY

| x(mm) | y(mm) | AMPLITUDE | PHASE |
|---|---|---|---|
| 0.0 | 10.82 | 0.707 | 0.0 |
| 0.0 | 3.29 | 1.0 | 0.0 |
| 0.0 | -3.29 | 1.0 | 0.0 |
| 0.0 | -10.82 | 0.707 | 0.0 |
| -11.15 | 0.0 | 0.707 | 0.0 |
| -5.57 | 0.0 | 1.0 | 0.0 |
| 5.57 | 0.0 | 1.0 | 0.0 |
| 11.15 | 0.0 | 0.707 | 0.0 |
| 7.09 | 9.59 | 0.707 | 0.0 |
| 7.09 | -9.59 | 0.707 | 0.0 |
| -7.09 | -9.59 | 0.707 | 0.0 |
| -7.09 | 9.59 | 0.707 | 0.0 |

Fig. 5

| PHASE ERROR | 0° | 6° | 12° | 18° | 24° | 30° |
|---|---|---|---|---|---|---|
| PEAK 0° CUT | 0.0 | 0.0 | 0.0 | 0.5 | 0.5 | 0.5 |
| PEAK 45° CUT | 0.0 | 0.5 | 1.0 | 1.5 | 2.0 | 2.5 |
| PEAK 90° CUT | 0.0 | 0.5 | 1.5 | 2.0 | 2.5 | 3.0 |
| PEAK 135° CUT | 0.0 | 0.5 | 1.0 | 1.0 | 1.5 | 2.0 |
| -15 dB Beam Width 0° CUT | 93.80 | 93.81 | 93.83 | 93.86 | 93.91 | 93.97 |
| -15 dB Beam Width 45° CUT | 94.99 | 94.96 | 94.89 | 94.78 | 94.61 | 94.39 |
| -15 dB Beam Width 90° CUT | 93.03 | 92.99 | 92.88 | 92.69 | 92.42 | 92.07 |
| -15 dB Beam Width 135° CUT | 94.99 | 94.98 | 94.95 | 94.90 | 94.84 | 94.75 |

Fig. 6

ARRAY FEED FOR AXIALLY SYMMETRIC AND OFFSET REFLECTORS

This application claims benefits of Provisional Appln. 60/013,682 filed Mar. 19, 1996.

FIELD OF THE INVENTION

This invention relates generally to antennas and more particularly relates to patch antennas.

BACKGROUND OF THE INVENTION

In order to achieve optimum, linear polarised patterns from an axially symmetric reflector or for an offset reflector, ideal field intensities and polarization at a focal plane of the reflector are generated. Ideal focal plane field intensities and polarisation are commonly generated using a scalar feed corrugated horn. One such horn is shown in U.S. Pat. No. 4,349,827, entitled "Parabolic antenna with horn feed array" to Bixler et al. Horns are designed to provide ideal focal plane field intensities and polarisation. Unfortunately, horns are fixed, three-dimensional structures thereby increasing antenna fragility and size.

Further, the use of a scalar feed horn for transmission requires a solid state power amplifier (SSPA) incorporating a power combiner at an output of parallel amplifiers. The combiner enables power delivery to the horn. A typical loss in the output combiner is 1.5 dB for a 14 GHz signal—or, 6 W for a 20 W feed.

It was proposed by K. Woo, in an article entitled "Array-fed reflector antenna design and applications", Second International Conference on Antennas and Propagation. 13–16 Apr., 1981, Part 1: Antennas, pp. 209–213, and by A. W. Rudge, in an article entitled "Current trends in antenna technology and prospects for the next decade", IEEE Antennas and Propagation Society Newsletter, Vol. 25, No. 6, December 1983, pp. 5–12, to use an active feed comprising parallel amplifiers feeding a rectangular array of equally spaced radiating elements to generate a signal having a same focal plane field pattern as a scalar feed; the loss is typically 0.5 dB. The lower amount of loss allows a similar number of amplifiers to provide more power than a same number of amplifiers driving a scalar feed horn, or allows elimination of one or more parallel amplifiers resulting in a same output power. The assembly of an active feed having an array of equally spaced radiating elements is less costly than that of a solid state power amplifier.

The benefits of the proposed designs are significant but, unfortunately, it is near impossible to match ideal focal plane field intensities and polarisation using the proposed active feed. Invariably, side lobes and other aberrations in the feed signal occur. Further, a number of amplifiers having different amplifications are necessary for such an active feed.

OBJECT OF THE INVENTION

It is an object of this invention to provide an active feed array for a reflector antenna.

It is also an object of this invention to provide a method of designing an active feed array for a reflector antenna.

SUMMARY OF THE INVENTION

In accordance with the invention there is provided a feed for a reflector antenna comprising a reflector, the feed comprising:

a) a substrate, b) a plurality of radiating elements each comprising at least a radiator, the radiators forming a first radiator disposed on the substrate for performing one of radiating a first signal toward the reflector and receiving a first signal from the reflector, and a group of radiators disposed on the substrate along a substantially closed curved path, each radiator within the group for performing one of radiating second signals toward the reflector and receiving second signals from the reflector;

wherein the radiating elements are irregularly spaced on the substrate and the first signal and the second signals are for substantially combining to produce a signal.

In an embodiment the irregularly spaced radiating elements preclude formation of a regularly spaced rectangular array through placement of zero or more further radiating elements wherein a regularly spaced rectangular array is an array of radiating elements centred at each crossing of equally spaced orthogonal lines forming a grid, and precludes formation of a regularly spaced circular array through placement of zero or more further radiating elements wherein a regularly spaced rectangular array is an array of radiating elements centred at each crossing of equally spaced concentric circles and lines passing through a centre of curvature of the circles and spaced from adjacent lines by equal angles.

In an embodiment the irregularly spaced radiating elements preclude formation of a regularly spaced rectangular array through placement of zero or more further radiating elements wherein a regularly spaced array is an array of radiating elements located at each crossing of equally spaced orthogonal lines forming a grid.

In an embodiment the irregularly spaced radiating element placements precludes formation of a regularly spaced circular array through placement of zero or more further radiating elements wherein a regularly spaced array is an array of radiating elements centred at each crossing of equally spaced concentric circles and lines passing through a centre of curvature of the circles and spaced from adjacent lines by equal angles.

In accordance with the invention there is provided a reflector antenna comprising a reflector;

a feed having a phase centre disposed substantially at a focal point of the reflector and directed thereto, the feed comprising:

b) an array of irregularly spaced radiating elements each comprising a radiator arranged along at least a path about at least a central radiator proximate the phase centre, each radiator within a path for performing one of receiving a signal from the reflector and radiating a signal toward the reflector;

wherein the signals are for combining to form a feed signal.

In accordance with the invention there is provided a method of designing a feed for a reflector antenna comprising the steps of:

providing desired field distribution and polarisation;

dividing the desired field into a plurality of component fields; and, for each component field, determining radiator locations for a group of radiators and a signal strength for radiating from each radiator in the group of radiators to substantially produce the associated component field at the reflector wherein a combination of component fields at the reflector results substantially in the desired field distribution and polarisation.

BRIEF DESCRIPTION OF THE DRAWINGS

Exemplary embodiments of the invention will now be described in conjunction with the attached drawings, in which:

FIG. 2*b* is a table of distances within the focal plane for predetermined normalised intensities;

FIG. 3*c* is a simplified diagram of an array of irregularly spaced microstrip patches;

FIG. 3*d* is a simplified diagram of an array of irregularly spaced microstrip patches with a regularly spaced grid aligned therewith;

FIG. 5 is a table of distances and amplitude weighting for a patch array feed at 14.25 GHz and according to the invention;

FIG. 6 is a table of pattern sensitivity to phase error for a patch array feed 14.25 GHz and according to the invention;

DETAILED DESCRIPTION OF THE INVENTION

When using an axially symmetric reflector or an offset reflector, a field having known field distribution and provided at a focal plane of the reflector results in a substantially efficient reflector antenna. Other fields, when provided, result in less efficient operation of the antenna. As was indicated, the field distribution is known, however, for each reflector geometry, wave length, etc. a different field distribution is optimal. Using a single signal from an amplifier or combined signals from a plurality of amplifiers as a feed to the reflector, does not produce the known field. Therefore, prior art implementations rely on a horn to guide the amplified signal to the reflector in accordance with the desired field distribution and polarisation.

When analysing ideal focal plane field intensities and polarisation for an offset reflector, it is common that a symmetric signal results. Though this is common, the invention described herein is applicable to asymmetric ideal focal plane field intensities and polarisation.

A main aspect of the invention is a method using a limited number of antenna elements of any form arranged on a flat plane for replicating a desired focal plane field. This said, the arrangement is selected to accommodate the antenna elements, a predetermined field distribution and predetermined polarity. A number of antenna elements and signals provided thereto are also selected in dependence upon the specific field distribution.

Figure 1:
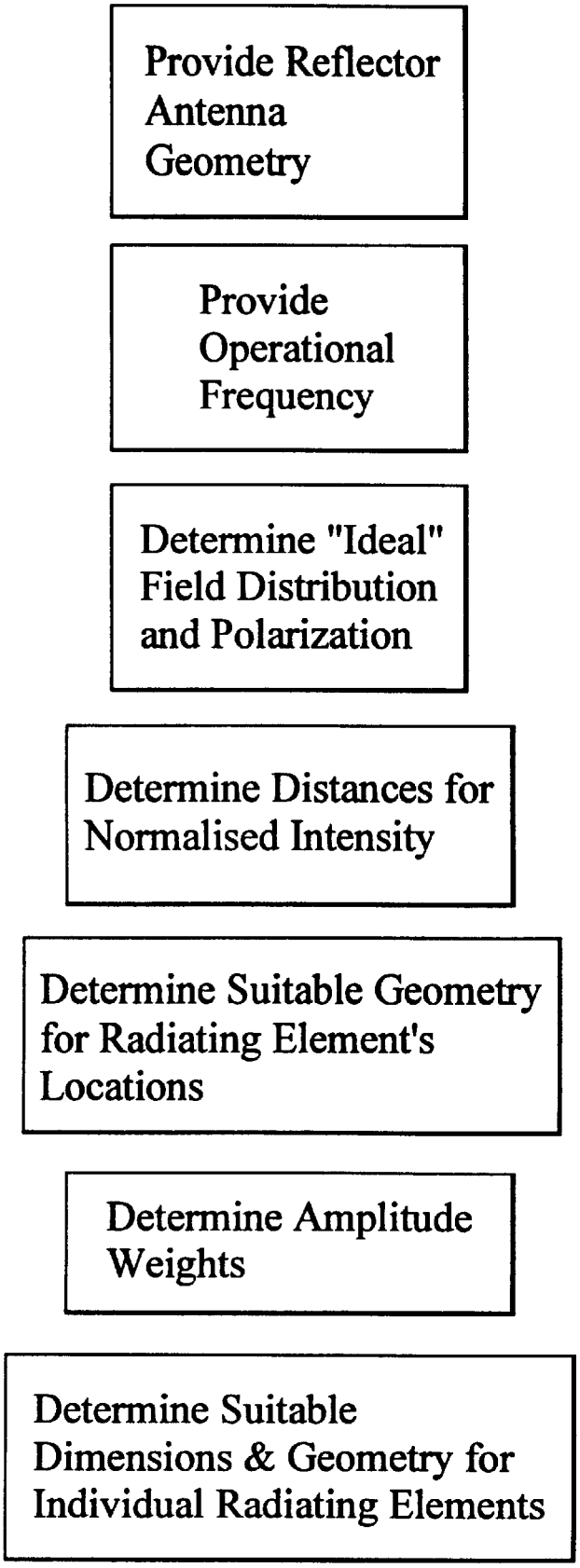
FIG. 1 is a simplified flow diagram of a method of designing an antenna feed array according to the invention.

Referring to FIG. 1, a simplified flow diagram of a method according to the invention is shown. A geometry of a reflector is provided. A substantially optimal field distribution in the focal region and corresponding to the reflector geometry is determined. For an offset reflector the substantially optimal field distribution is calculated as:

$$\frac{E_x}{E_o} = \frac{2J_1(u)}{u} + \frac{4}{\tau}\tan\frac{\theta_o}{2}\frac{J_2(u)}{u}\cos\phi_2$$

$$\frac{E_y}{E_o} = -j\frac{4}{\tau}\tan\frac{\theta_o}{2}\frac{J_2(u)}{u}\sin\phi_2$$

$$\frac{E_z}{E_o} = -j\frac{4}{\tau}\frac{J_2(u)}{u}\cos\phi_2$$

where $J_1$ and $J_2$ are the first and second order Bessel Functions;

u is the normalised distance on the focal plane from the focus $$u = -j\frac{4\pi r_2}{\lambda\tau}$$

$$\tau = \frac{2(\cos\theta_o + \cos\theta_m)}{(1+\cos\theta_o)\sin\theta_m};$$

$\phi_2$ is a polar co-ordinate on the focal plane with respect to the axis of symmetry of the offset reflector;

$r_2$ is the distance on the focal plane from the focus;

$\theta_o$ is the offset angle of the offset reflector; and, $\theta_m$ is the flare angle of the offset reflector.

Figure 2:
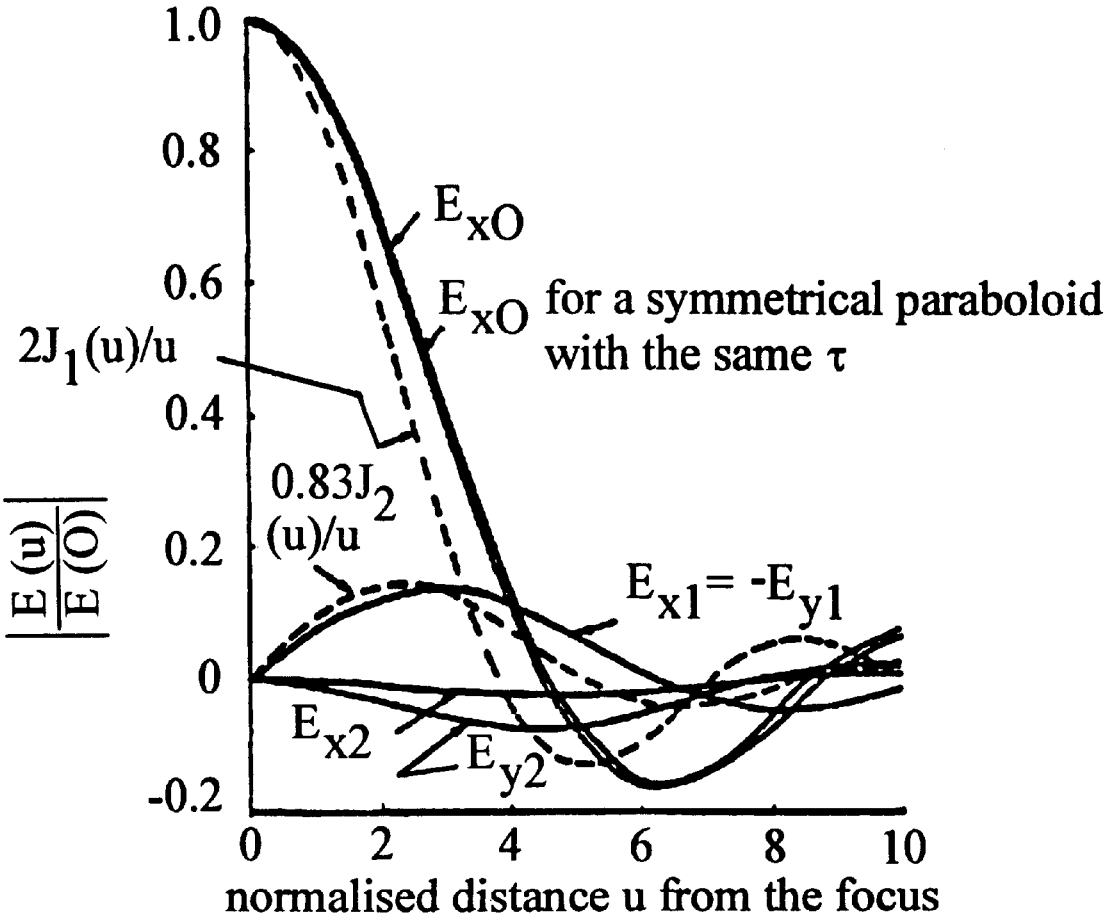
FIG. 2 is a graph of a sample ideal field distribution in a focal plane.
Figure 2:
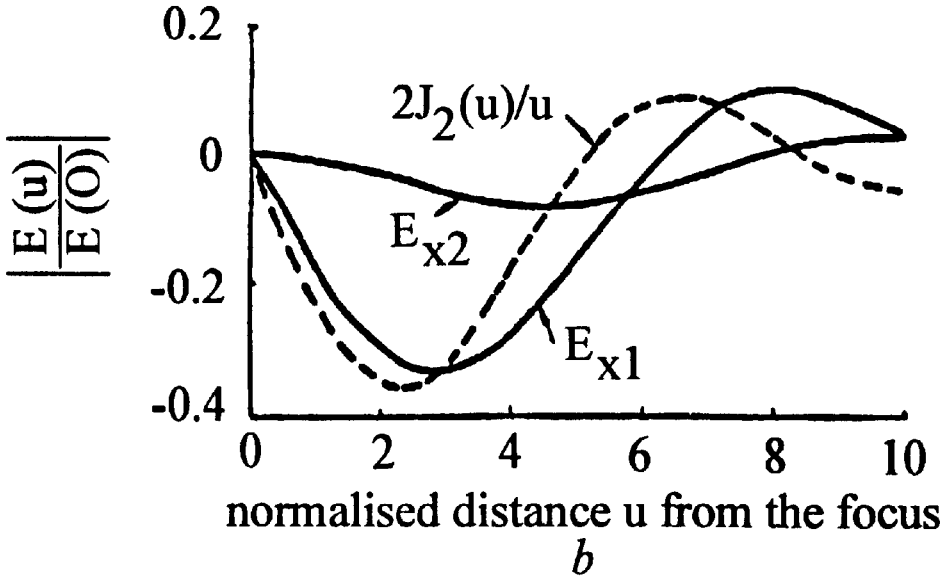

Referring to FIG. 2, a normalised field distribution in a focal plane of an offset parabolic reflector having $\tau=2$ is shown. Design of the array geometry for the active feed comprises the steps of locating and orienting radiators in the form of radiating edges of radiating elements in the form of rectangular patches on a focal plane of the offset reflector such that power densities and polarisation at those locations replicate that of an ideal feed. Power weighting over this sample focal plane is achieved by using some amplifiers to feed individual patches and some amplifiers to feed two or more patches. Further power weighting is achieved by closely positioning some radiators in the form of patch edges so that the powers radiated by their adjoining edges combine. As such, power weights of 0.25, 0.5, 0.75, and 1.0 are achievable corresponding to field intensity weights of 0.5, 0.707, 0.866, and 1.

As each opposing edge of a patch receives a same signal for radiating, the edges 1 and 2 are located proximate each other and the opposing edges 3 and 6 are located at a location an amplitude of substantially half the central amplitude. When this is not the case, as may occur when circularly polarised radiation is required, the feed will be less than optimal. In order to correct for this error, it is possible to reduce efficiency by moving the feed centre from the focal point of the reflector to a location wherein the feed distribution is appropriate.

There are several variables in the feed design process according to the invention. Radiating element locations on a substrate are not fixed, and radiated powers for each radiating element are not fixed. Therefore, in a preferred embodiment of the invention, radiated powers are fixed at convenient levels. Described herein is the geometric progression of radiated power 0.25, 0.5, 0.75, 1. Optionally, other power weights are used.

With the power weights fixed, the remaining variables are solved; patch geometry and radiator location are determined. Once the radiator locations and consequently locations of radiating elements in the form of patches are determined, the patches are sized to fit within assigned locations such that, when necessary, the radiators are located as determined. Sizing of microstrip patches is well known in the art of microstrip patch designs. $\epsilon_r$ is selected to allow patch sizes small enough to be placed at the determined locations without overlapping.

The patches and associated amplifiers are then assembled to form an array feed for the reflector antenna. The feed is placed within the focal plane of the reflector. Essentially, the phase centre of the feed is located at the focal point of the reflector. When used in a transmitting mode, the feed transmits a signal received from the amplifiers toward the reflector; when used in a receiving mode the feed provides a received signal to the amplifiers. Altering the placement of the feed reduces its efficiency.

EXAMPLE

The design of an active feed for a commercial Ku band offset reflector having an offset angle and a flare angle of 38 degrees is presented as an example. The reflector has a $\tau$ of 2.88. Using the above equations, normalised distance u, and corresponding un-normalised distance r2 for a provided frequency of 14.25 GHz, for the above normalised intensities are shown in a table presented in FIG. 2*b*.

Microstrip patch arrays are well known. Typically, patch arrays are arranged in rectangular arrays with patch centres located at crossings of equally spaced parallel and perpendicular lines defining a grid. In many microstrip patch applications, a rectangular regularly spaced array is used during design and those elements transmitting and receiving substantially no signal are not included in the final array. Such an array appears irregularly spaced, but in fact, is regularly spaced with some patches absent from the array. Similarly, circular arrays wherein patch centres are located at a crossing of concentric circles and lines passing through a central location and having equal angles between each pair of adjacent lines are known.

Figure 3A:
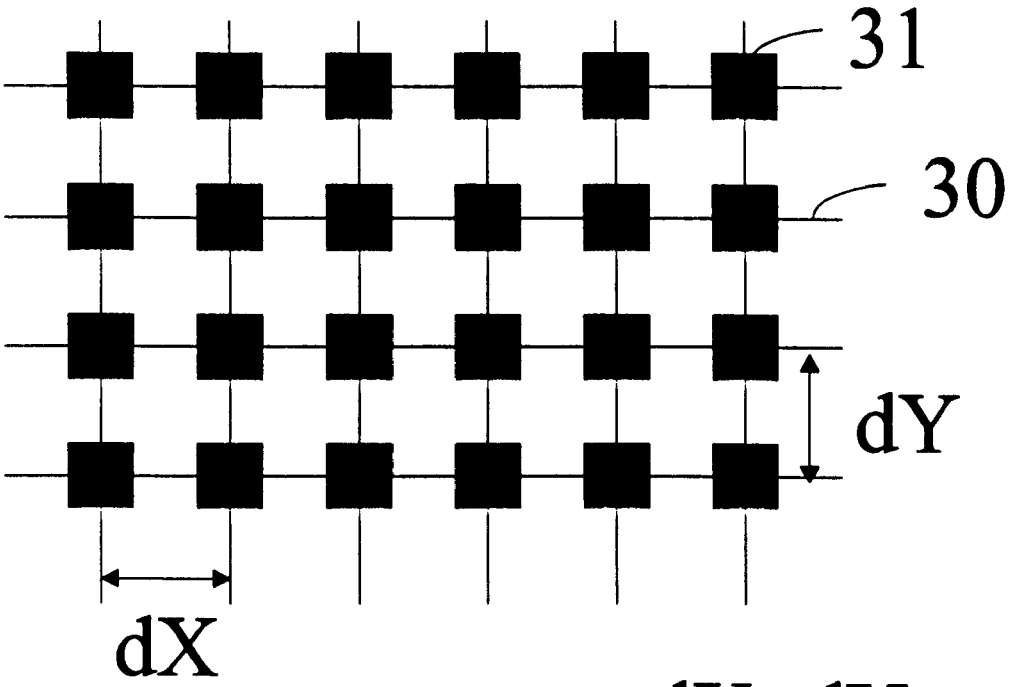
FIG. 3*a* is a simplified diagram of a populated regular array of microstrip patches.

Irregularly spaced arrays often appear similar to regularly spaced arrays having some patches removed. Referring to FIG. 3*a,* a regularly spaced array of radiating elements in the form of microstrip patches is shown. Arrays having similar geometries with varying scales are well known. A grid 30 having regular spacing in both vertical and horizontal directions is shown. Centred on grid intersections are radiating elements in the form of microstrip patches 31. The patch locations are uniformly distributed on the grid 30 and the patch dimensions are uniform.

Figure 3B:
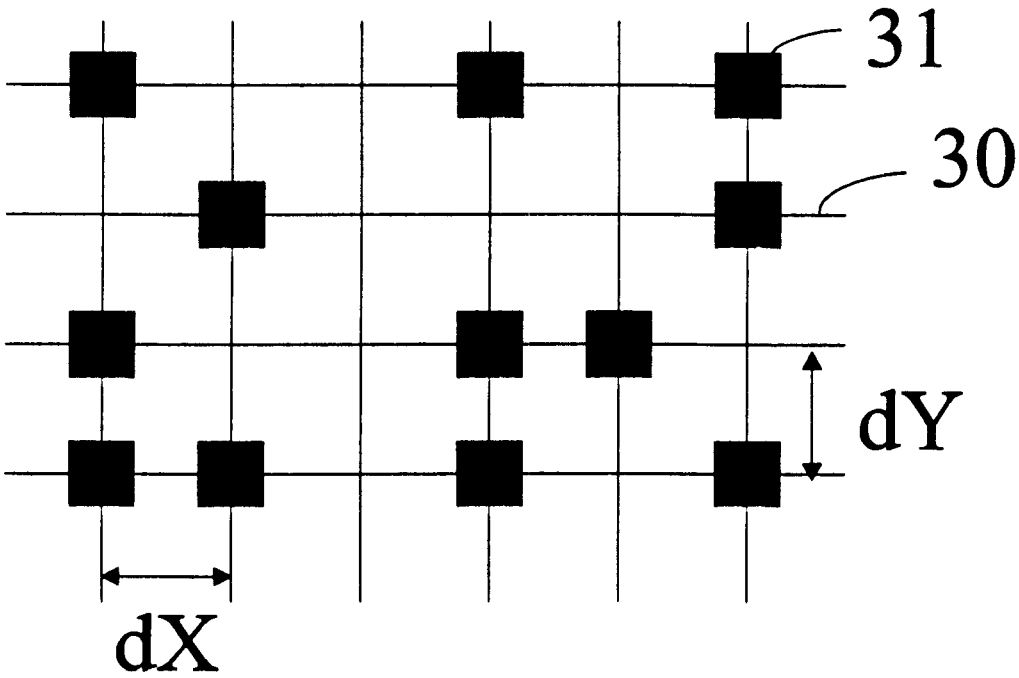
FIG. 3*b* is a simplified diagram of a depopulated array of regularly spaced microstrip patches.

Referring to FIG. 3*b,* a depopulated regular array of radiating elements is shown. The microstrip patches 31 fall at intersections of the grid 30. The removal of patches due to non use or to reduce cost is known. In applications where unused patches are removed, a sparse patch array such as that of FIG. 3*b* results; however, such an array is a regular array.

Referring to FIG. 3*c,* an irregular array of microstrip patches 30 is shown. A patch 30*a* is shifted ⅕ of dX and another patch is shifted ⅕ of dX in another direction. As shown in FIG. 3*d,* a grid 30*d* having intersections at the centre of each radiating element 30 is too close spaced to allow for regular population of the grid. Placing a microstrip patch 30 at every grid intersection results in patch overlap which results in a substantially single large patch.

Figure 3E:
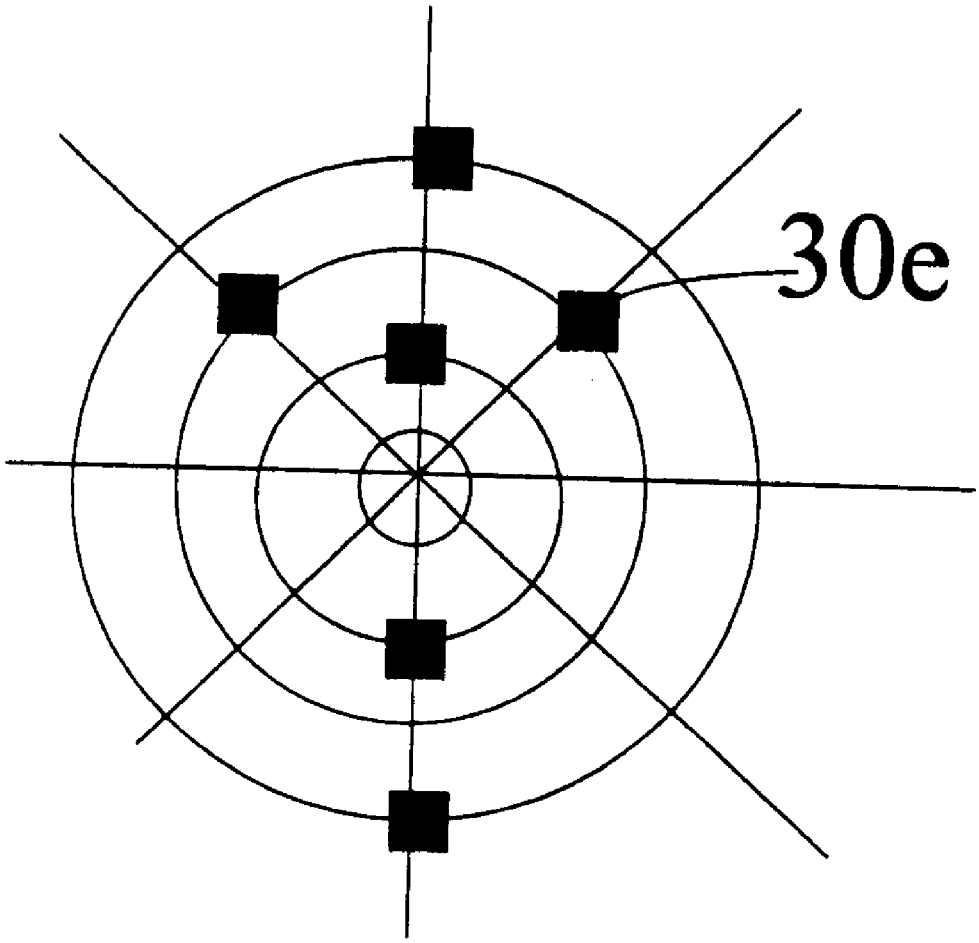
FIG. 3*e* is a simplified diagram of a circular array of regularly spaced microstrip patches.

Referring to FIG. 3*e,* a regularly spaced circular array of microstrip patches 30 is shown. The array is formed of a grid 30*e* comprising equally spaced concentric circles and a plurality of straight lines passing through a centre of curvature of the circles and having an equal angle between adjacent lines. Radiating elements in the form of microstrip patches 30 are centred on the grid intersections. As is evident to those of skill in the art, moving a patch location less than a patch width from a grid intersection results in patch placement such that equally spaced concentric circles and lines passing through a centre of curvature of the circles and having an equal angle between adjacent lines can no longer support a radiating element placed at every grid intersection without overlap. Other patch relocation may result in similar irregular grids. In this specification and the claims the terms irregular, irregular array, and irregular spacing are used having meanings consistent with the aforementioned meaning of irregular as explained with reference to FIGS. 3*a* to 3*e*.

Figure 4:
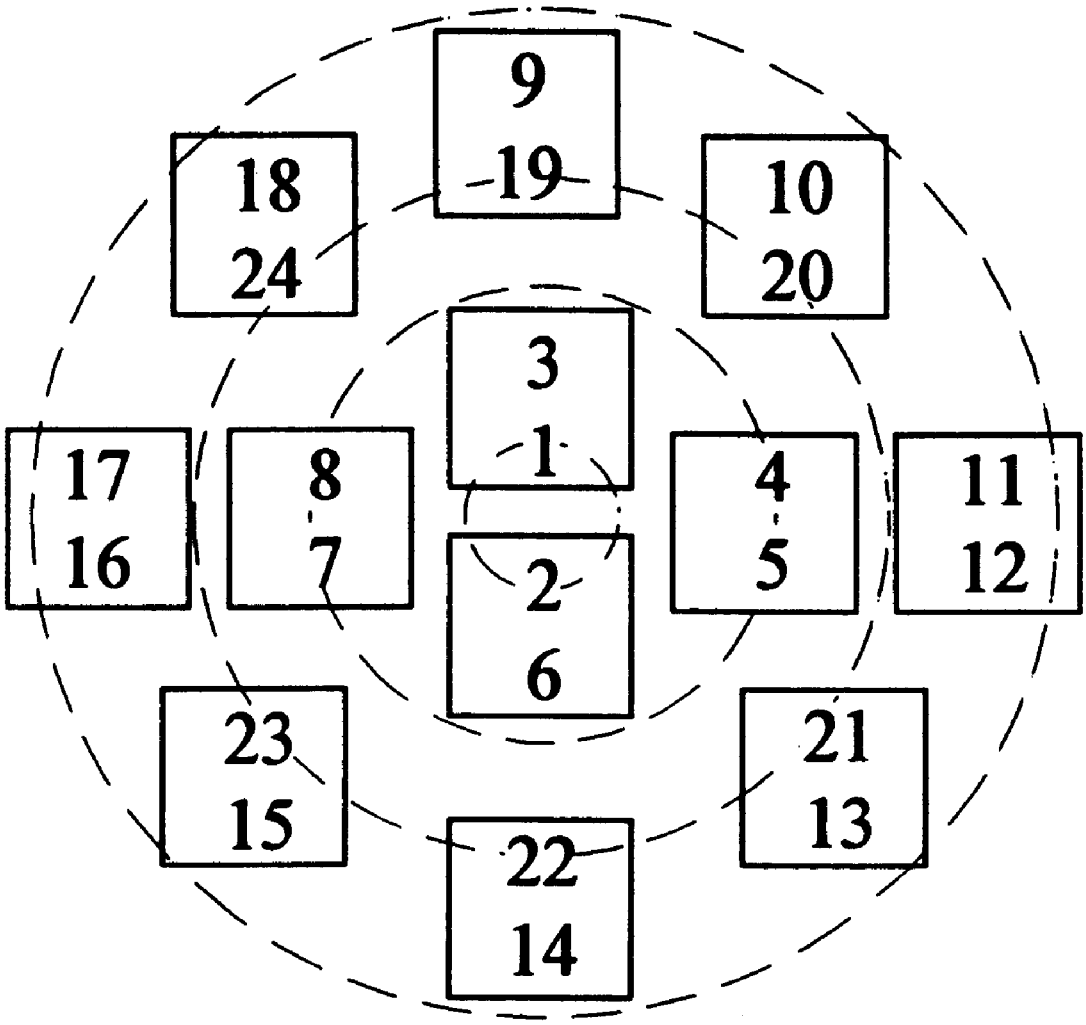
FIG. 4*a* is a diagram of a location geometry for radiating elements according to an embodiment of the invention.

Referring to FIG. 4, an array geometry determined in dependence upon the normalised intensities including amplitude weights is shown. The array geometry is determined such that signals radiated from each radiator combine to form substantially the determined field distribution. The array geometry shown has radiating elements in the form of microstrip patches with radiators in the form of patch edges falling on the focal plane at predetermined locations associated with the above field intensities.

The array geometry shown is not a regularly spaced rectangular array; each patch location is selected to provide a portion of the desired ideal field distribution. A quick measurement between patch centres establishes that they are not equidistant and that the space therebetween is insufficient to allow placement of further similar patches. The central two patches labelled 3/1 and 2/6 each radiate two signals. 1 and 2 radiate a signal corresponding to the uppermost ring. 3, 6, 8/7, and 4/5 radiate a signal corresponding to the next ring, etc. Due to the symmetric nature of the ideal field distribution shown in FIG. 2, 1 and 2 receive a same signal from an amplification circuit; 3,6,8/7, and 4/5 also receive a same signal. The proximity of radiators 1 and 2 allows signals radiated therefrom to substantially sum. Therefore, radiators 1 and 2 provide a substantially single signal having an amplitude of twice that radiated by the ring of radiators 3,6,8/7, and 4/5. As a summation of radiated signals occurs at the reflector, amplification for each patch is less than the amplification required for a horn fed reflector where all energy is directed through the horn. The use of multiple amplifiers of lower amplification reduces overall system cost.

The use of the term ring in the specification refers to a closed path. Examples of rings are ellipses, circles, or irregular shapes. It is evident to those of skill in the art that ring geometry varies in dependence upon reflector geometry. Of note is that all radiators in the form of patch edges within a group are parallel to provide a predetermined polarity. When polarity is unimportant this need not be so. Each radiating element in the form of an edge is located such that the centre of the radiating element falls on a point on the ring.

For use with circularly polarised signals, patch dimensions are significant. In order to ensure correct patch geometry, a suitable reflector is selected. Alternatively, a feed located in a less than optimal location is employed or a filter or reflector is used to circularly polarise a signal radiated in accordance with the invention.

In use, the radiated signals from radiators in the form of microstrip patch edges 1 and 2 are summed substantially at a centre of a desired field distribution. Of course, when non-symmetric field distributions are desired, the summation may not occur at a central location. The summing of the radiated signals results in an equivalent signal having twice the amplitude of each radiated signal. When 3,6,8/7, and 4/5 also receive a same signal, this amounts to half the amplitude of the substantially centre amplitude. Referring to FIG. 2, the centre amplitude is considerably higher than peripheral amplitudes. It is, therefore, possible according to the invention to locate the radiators 3,6,8/7, and 4/5 such that radiated signals when summed with those radiated from the two central radiating elements, results in a field distribution substantially similar to that of FIG. 2. It will be apparent to those of skill in the art, that more cross sections reduces error and reduces an occurrence of side lobes.

Referring to FIG. 4, a further group of radiating elements is disposed around the group of radiating elements 3,6,8/7, and 4/5 to radiate a further signal. The signal provided to these radiating elements is ½ the amplitude of that provided to the radiating elements described heretofore. Again, the location of the radiating elements is selected to radiate signals that sum with those signals radiated by the other elements in order to better approximate the desired field distribution. It should be evident to those of skill in the art that radiating element placement is significant and that an efficient regularly spaced array of radiating patches results in significant complexity of the amplifiers and also results in considerable side lobes.

Once a geometry is determined for the radiating element placement, an amplitude weighting or amplification amount is determined for each radiating element. Using a geometry as shown in FIG. 4, a plurality of patches is associated with a predetermined amplification amount. These amounts correspond to integral levels of amplification such as 2, 1, ½, and ¼. Determined microstrip patch locations and amplitude weights therefor are shown in the table of FIG. 5.

Once the general design criteria are established, the patches or other radiating elements are designed to meet the design criteria. In order to size individual patches to achieve the determined locations for patch edges, a substrate having $\epsilon_r$=6.15 and h=0.635 mm was selected. Sizing of other forms of radiating elements is known in the art.

The resulting design of this example was simulated to allow comparison between the desired field distribution, a field distribution provided using currently available feed horns, and the field distribution using an antenna according to the invention. The simulation was performed using ARPS® tool from Farfield® Inc. The patterns were determined in 10 degree cuts from 0 degrees for 14 GHz, 14.25 GHz, and 14.5 GHz. Some simulation results are provided in Appendix A. Of note are the following results: the patterns show excellent axial symmetry, the patterns behave substantially similarly to the patterns of a feed horn; phase errors as large as 6 degrees had minimal effects on beam peak locations or beam widths. This final observation is evident from results shown in a table of FIG. 6.

In the above example, slot fed microstrip patch antenna elements were employed. According to the invention other radiating elements such as slot fed dielectric resonators. dipoles, slots, etc. are also suitable radiating elements for use in the invention. Further, other feeds such as probe feeds are suitable feeds for the radiating elements. When a radiator in the form of a slot is used, half of radiation emitted is lost as a slot radiates in two opposing directions. Preferably, a lens is used to direct energy one of above and below a substrate in which the slots are located. The direction of the energy is selected to direct the energy toward the reflector. Alternatively, a loss of substantially 50% occurs.

Figure 7:
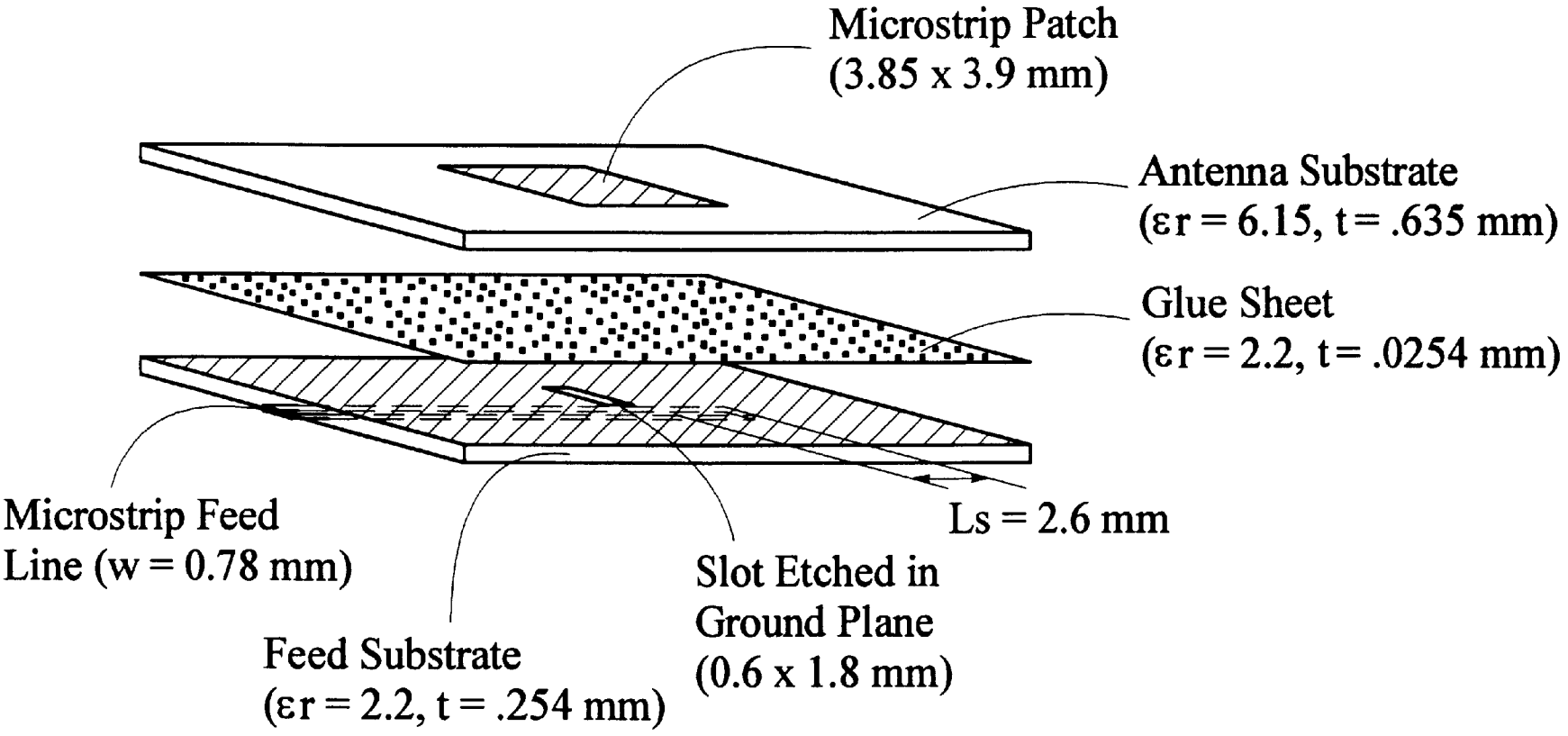
FIG. 7 is an exploded view of a slot fed microstrip patch.

In general, the microstrip patch with a slot feed was selected due to its ease of manufacture and low cost. Further, microstrip patch geometry is easily alterable by varying the material used for the substrate and the patch dimensions. For a slot fed microstrip patch radiating element, a multi layer configuration was used. Such a patch configuration is shown in FIG. 7. A thin layer of glue is disposed between a feed layer comprising a feed slot and a microstrip feed and the antenna layer comprising a substrate and a microstrip patch. Dimensions for the microstrip patch employed are shown in FIG. 7.

The antenna feed described in the above example was manufactured and tested. The results were in accordance with the simulation results and some of those results are presented in Appendix B. Though the above example describes a transmit antenna, the method according to the invention and the antenna feed described herein is also applicable to a receive antenna element or to a transmit/receive antenna element.

The present invention comprises a method of defining the number and placement of antenna elements for a particular form of replicating a desired local plane field. The method results in a design for a sparsely populated array of feed elements utilising very coarse amplitude weightings such that the desired field intensities and polarisation produced by the radiators on a focal plane of a reflector achieve a desired radiation pattern. In an embodiment, the method comprises the steps of:

a) Placing two radiators close together, but not connected, at a focal point of the reflector in order to establish two closely spaced sampling points each having a normalised power density of 1, and a combined normalised power density of 2;

b) Placing a first group in a ring of typically 6 radiators around the two focal point radiators, each radiator having a normalised power density of 1, and positioned on the focal plane at locations where the theoretical normalised power density should be ½ that of the focal point and oriented to provide the theoretical polarisation of the focal plane; and, c) Placing a second group in a ring of typically 10 radiators around the previous ring, each having a normalised power density of ½, and positioned on the focal plane at locations where the theoretical normalised power density should be ¼ that of the focal point and oriented to provide the theoretical polarisation of the focal plane.

Though the first and second groups are disposed in rings, the rings need not be symmetrical or circular in nature. Ring geometry is determined in dependence upon the desired field distribution and polarisation.

Using the array geometry set out according to the present embodiment, each of the two focal point radiators, the 6 inner ring radiators and 4 pairs of the 8 outer ring radiators are driven with identical power amplifiers for transmit applications; and are equally combined prior to provision to a low noise amplifier (or connected to identical low noise amplifiers before being equally combined) for receive applications.

Other numbers of focal point radiators, numbers of inner ring radiators, numbers of outer ring radiators, and any number of rings employed and configured for use according to the invention fall within the scope of the invention.

For outer rings, it is evident that some radiators in the form of patch edges are not located according to the invention. This is a limitation of using patches. As a patch radiates a same signal from opposing edges, outer rings falling on a patch edge, are affected by the other patch edge. The effects result in some error; according to experimental results, the error is acceptable.

A preferred embodiment of the method for achieving an ideal focal plane field for a parabolic reflector utilising microstrip patch radiating elements has been demonstrated. This embodiment of the focal plane feed is shown in FIG. 4 where radiators in the form of radiating edges 1 and 2 provide the focal point pair of elements, radiators in the form of radiating edges 3 through 8 provide the inner ring, and radiators in the form of radiating edges 9 through 18 provide the outer ring. Radiators in the form of radiating edges 19 through 24 are superfluous, but are supportive in providing the desired focal plane field. In this embodiment, the microstrip dielectric constant is chosen such that radiating edges 3 and 6 are located at predetermined locations.

In a further embodiment, receive capability is integrated with a transmit feed array through several methods. A receive (Rx) array is designed in a similar manner to that of the transmit (Tx) array. The two arrays are interlaced on a same surface or in a stacked configuration (multi-layer). A preferred embodiment, shown in FIG. 8 comprises a microstrip patch array for Tx and a microstrip patch array for Rx located on a same surface. The antenna feed shown in FIG. 8, has different transmit and receive characteristics and amplifiers used therewith are designed to compensate for these differences. Alternatively, other compensation is provided.

Figure 9:
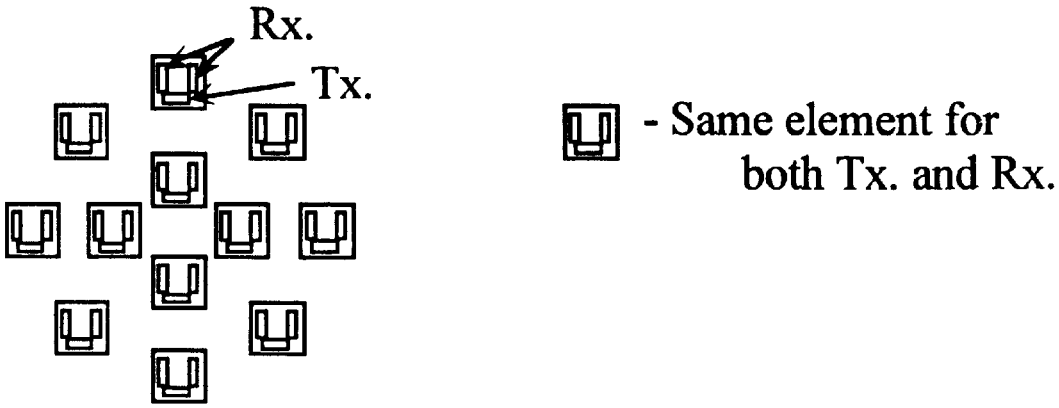
FIG. 9 is a simplified diagram of a patch array feed according to the invention for operation in a transmitter, a receiver, or a transceiver wherein each patch operates as both a transmitter and receiver.

Alternatively, as shown in FIG. 9, a same antenna element used within a transmit array is designed to operate at both Tx and Rx frequency bands. In a preferred embodiment, a microstrip patch array having a 3-point feed for providing isolation between Tx and Rx frequency bands is employed. The microstrip patches are designed to resonate at two frequency bands where orthogonal polarisation is imposed.

Figure 10:
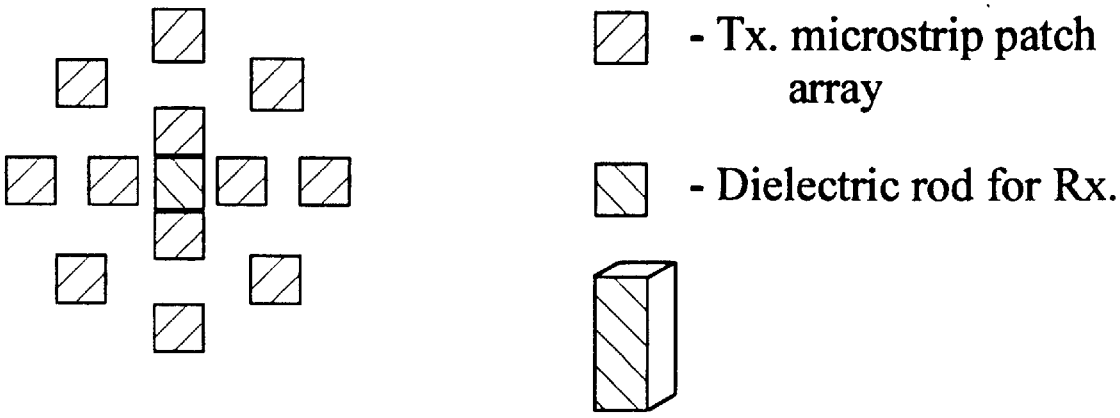
FIG. 10 is a simplified diagram of a feed array according to the invention for operation in a transmitter, a receiver, or a transceiver.
Figure 11:
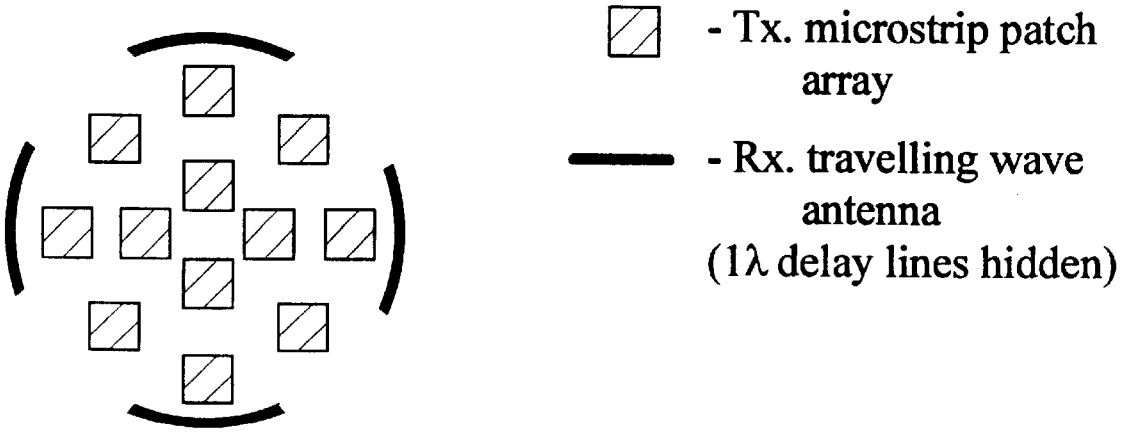
FIG. 11 is a simplified diagram of a feed array according to the invention for operation in a transmitter, a receiver, or a transceiver; and, FIG. 12 is a simplified diagram of a feed array according to the invention for operation in a transmitter, a receiver, or a transceiver.

Referring to FIG. 10, a single element is used for Rx and is disposed central to the Tx feed array. The single element requires a single feed with a single low noise amplifier within its path. A preferred embodiment is a dielectric rod antenna for Rx. An alternative embodiment, shown in FIG. 11, uses a travelling wave antenna in place of the dielectric rod. The travelling wave antenna is provided with phase delay lines (not shown) connecting radiating segments 100.

Figure 8:
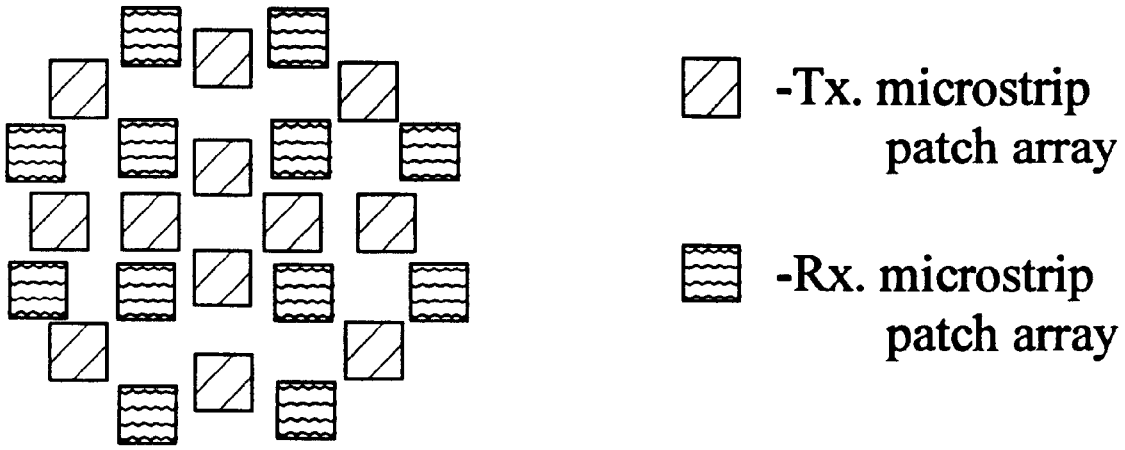
FIG. 8 is a simplified diagram of a feed array according to the invention for operation in a transmitter, a receiver, or a transceiver.
Figure 12:
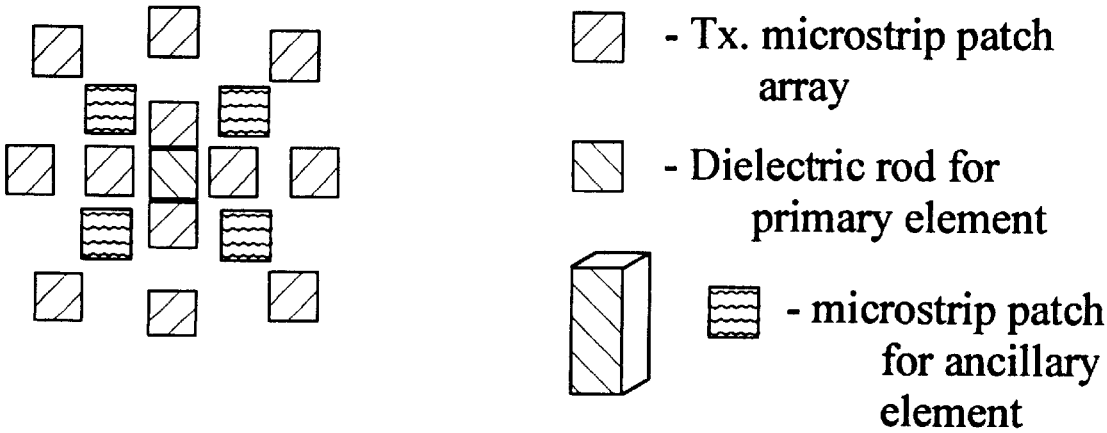

Referring to FIG. 12, a combination of the antennas shown in FIGS. 8 and 10 is presented. The antenna elements are formed using different technologies. A preferred embodiment is a primary radiator in the form of a dielectric rod with ancillary radiators in the form of microstrip patches to enhance radiation of the primary radiator. A variation of this embodiment employs ancillary radiators in the form of low gain dielectric radiating elements.

It is apparent to those of skill in the art that a choice between above noted approaches depends upon frequency proximity between Tx and Rx bands. It is of note that an ability to optimise both Rx and Tx bands with the above integrated Tx/Rx configurations is achievable because separate arrays are utilised for each frequency band.

Several advantages to the antenna feed according to the invention exist. As amplifier costs are different than with a horn fed reflector antenna, applications exist where cost benefits exist using an array feed. Since combiners and large amplifiers suffer reduction in efficiency at high frequencies, the disclosed array feed provides improved efficiency at higher frequencies. The feed array is substantially flat allowing for collapsible operation of the reflector antenna for portable operations.

When used as a replacement for a horn, amplifiers within the feed network for the reflector feed are obviated. The amplified signal for provision to the horn is provided to the irregularly spaced array of radiating elements. Attenuators and other passive devices are used, when necessary, to reduce signal amplitude for provision to radiating elements disposed along outer rings.

Numerous other embodiments may be envisaged without departing from the spirit and scope of the invention.

What is claimed is:

1. A feed for a reflector antenna comprising a reflector, the feed comprising:

a substrate;

a plurality of radiating elements each comprising at least a radiator, the radiating elements forming a first radiator disposed on the substrate for performing one of radiating a first signal toward the reflector and receiving a first signal from the reflector, and a group of radiating elements disposed on the substrate along a substantially closed curved path, each radiator within the group for performing one of radiating second signals toward the reflector and receiving second signals from the reflector;

wherein the radiating elements are disposed on the substrate in a pattern other than regularly spaced rectangular array and other than a regularly spaced circular array, wherein the pattern precludes formation of a regularly spaced array through placement of one or more further radiating elements and the first signal and the second signals are for substantially combining to produce a signal.

2. A feed for a reflector antenna according to claim 1 wherein the irregularly spaced radiating elements preclude formation of a regularly spaced rectangular array through placement of one or more further radiating elements wherein a regularly spaced rectangular array is an array of radiating elements centred at each crossing of equally spaced orthogonal lines forming a grid, and precludes formation of a regularly spaced circular array through placement of one or more further radiating elements wherein a regularly spaced circular array is an array of radiating elements centred at each crossing of equally spaced concentric circles and lines passing through a centre of curvature of the circles and spaced from adjacent lines by equal angles.

3. A feed for a reflector antenna according to claim 1 wherein the irregularly spaced radiating elements preclude formation of a regularly spaced rectangular array through placement of one or more further radiating elements wherein a regularly spaced array is an array of radiating elements located at each crossing of equally spaced orthogonal lines forming a grid.

4. A feed for a reflector antenna according to claim 1 wherein the irregularly spaced radiating element placements precludes formation of a regularly spaced circular array through placement of one or more further radiating elements wherein a regularly spaced circular array is an array of radiating elements centred at each crossing of equally spaced concentric circles and lines passing through a centre of curvature of the circles and spaced from adjacent lines by equal angles.

5. A feed for a reflector antenna according to claim 1 wherein the first radiator is for receiving a first radiator signal and radiating the first signal in dependence upon the received signal toward the reflector and each radiator in the group of radiators is for receiving a same signal other than the first radiator signal and for radiating the second signal in dependence upon the same signal toward the reflector, the first and second signals for substantially combining and reflecting to produce a reflected radiated signal.

6. A feed for a reflector antenna according to claim 1 wherein the first radiator is for receiving the first signal reflected by the reflector and for providing the received first signal to a radiating element feed and each radiator in the group of radiators is for receiving a second signal reflected by the reflector and for providing the received second signal to radiating element feeds, the first and second signals for substantially combining to produce a received signal.

7. A feed for a reflector antenna according to claim 1 wherein the first radiator is for receiving a first radiator signal and radiating the first signal in dependence upon the received signal toward the reflector and each radiator in the group of radiators is for receiving a same signal other than the first radiator signal and for radiating the second signal in dependence upon the same signal toward the reflector, the first and second signals for substantially combining and reflecting to produce a reflected radiated signal and wherein the plurality of radiating elements forms another group of radiating elements each comprising at least a radiator for receiving another signal reflected by the reflector and for providing the received another signal to radiating element feeds to form a received signal.

8. A feed for a reflector antenna according to claim 1 wherein the radiating elements are microstrip patches.

9. A feed for a reflector antenna according to claim 1 wherein the radiators are radiating element edges.

10. A feed for a reflector antenna according to claim 1 wherein the radiators comprise slots formed within the ground plane of the substrate and having a plurality of sides wherein electromagnetic radiation across opposing sides of the slot are radiated.

11. A feed for a reflector antenna according to claim 1 further comprising an amplifier for amplifying a signal provided thereto, the amplifier coupled to the first radiating element for amplifying a signal provided thereto relative to a signal provided to radiators within the group of radiating elements.

12. A feed for a reflector antenna according to claim 1 further comprising an amplifier coupled to a plurality of radiating elements within the group of radiating elements.

13. A feed for a reflector antenna as defined in claim 1 further comprising:

at least an amplifier;

a further group of radiating elements each comprising a radiator, each radiating element within the further group coupled to an amplifier from the at least an amplifier and each radiator for performing one of radiating further signals toward the reflector and receiving further signals from the reflector, wherein the further signals are amplified differently from further signals provided to the group of radiating elements.

14. A feed for a reflector antenna as defined in claim 1 further comprising:

at least one attenuator;

a further group of radiating elements each comprising a radiator, each radiating element within a group coupled to an attenuator from the at least an attenuator and each radiator for receiving signals attenuated by the attenuator and radiating said signals toward the reflector.

15. A feed for a reflector antenna according to claim 1 further comprising an attenuator coupled to a plurality of radiating elements within the group of radiating elements.

16. A reflector antenna comprising a reflector;

a feed having a phase centre disposed substantially at a focal point of the reflector and directed thereto, the feed comprising:

an irregularly spaced array of radiating elements each comprising a radiator arranged along at least a path about at least a central radiator proximate the phase centre, each radiator within a path for performing one of receiving a signal from the reflector and radiating a signal toward the reflector;

wherein the signals are for combining to form a feed signal.

17. A reflector antenna according to claim 16 wherein the irregularly spaced radiating elements preclude formation of a regularly spaced rectangular array through placement of one or more further radiating elements wherein a regularly spaced rectangular array is an array of radiating elements centred at each crossing of equally spaced orthogonal lines forming a grid, and precludes formation of a regularly spaced circular array through placement of one or more further radiating elements wherein a regularly spaced rectangular array is an array of radiating elements centred at each crossing of equally spaced concentric circles and lines passing through a centre of curvature of the circles and spaced from adjacent lines by equal angles.

18. A reflector antenna according to claim 16 wherein the irregularly spaced radiating elements preclude formation of a regularly spaced rectangular array through placement of one or more further radiating elements wherein a regularly spaced array is an array of radiating elements located at each crossing of equally spaced orthogonal lines forming a grid.

19. A reflector antenna according to claim 16 wherein the irregularly spaced radiating element placements precludes formation of a regularly spaced circular array through placement of one or more further radiating elements wherein a regularly spaced array is an array of radiating elements centred at each crossing of equally spaced concentric circles and lines passing through a centre of curvature of the circles and spaced from adjacent lines by equal angles.

20. A reflector antenna according to claim 16 wherein the first radiator is for receiving a first radiator signal and radiating the first signal in dependence upon the received signal toward the reflector and each radiator in the group of radiators is for receiving a same signal other than the first radiator signal and for radiating the second signal in dependence upon the same signal toward the reflector, the first and second signals for substantially combining and reflecting to produce a reflected radiated signal.

21. A reflector antenna according to claim 16 wherein the first radiator is for receiving the first signal reflected by the reflector and for providing the received first signal to a radiating element feed and each radiator in the group of radiators is for receiving a second signal reflected by the reflector and for providing the received second signal to radiating element feeds, the first and second signals for substantially combining to produce a received signal.

22. A reflector antenna according to claim 16 wherein the first radiator is for receiving a first radiator signal and radiating the first signal in dependence upon the received signal toward the reflector and each radiator in the group of radiators is for receiving a same signal other than the first radiator signal and for radiating the second signal in dependence upon the same signal toward the reflector, the first and second signals for substantially combining and reflecting to produce a reflected radiated signal and wherein the plurality of radiating elements forms another group of radiating elements each comprising at least a radiator for receiving another signal reflected by the reflector and for providing the received another signal to radiating element feeds to form a received signal.

23. A reflector antenna according to claim 16 wherein the radiating elements are microstrip patches.

24. A reflector antenna according to claim 16 wherein the radiators are radiating element edges.

25. A reflector antenna according to claim 16 wherein the radiators comprise slots formed within the ground plane of the substrate and having a plurality of sides wherein electromagnetic radiation across opposing sides of the slot are radiated.

26. A reflector antenna according to claim 16 further comprising an amplifier coupled to at least a radiating element from the array of irregularly spaced radiating elements for amplifying a signal provided thereto so that it is amplified relative to a signal provided to another radiating element.

27. A method of designing a feed for a reflector antenna comprising the steps of:

providing desired field distribution and polarisation;

dividing the desired field into a plurality of component fields; and, for each component field, determining radiator locations for a group of radiators and a signal strength for radiating from each radiator in the group of radiators to substantially produce the associated component field at the reflector wherein a combination of component fields at the reflector results substantially in the desired field distribution and polarisation.

28. A method of designing a feed for a reflector antenna as defined in claim 27 wherein the radiators are microstrip patch edges.

29. A method of designing a feed for a reflector antenna as defined in claim 27 further comprising the steps of:

selecting cross sections of the field distribution, the cross section of a three-dimensional field distribution and taken along a plane parallel to a ground field distribution; and, associating a component field with a selected cross section.

30. A method of designing a feed for a reflector antenna as defined in claim 29 wherein the step of selecting cross sections of the field distribution is performed in dependence upon predetermined levels of power within the field distribution.

* * * * *